United States Patent [19]

Papadatos

[11] Patent Number: 4,665,789

[45] Date of Patent: May 19, 1987

[54] CHORD SELECTOR FOR A STRINGED INSTRUMENT

[76] Inventor: Evangelos A. Papadatos, 3602 Barcroft View Ter., Apt. 103, Falls Church, Va. 22041

[21] Appl. No.: 746,267

[22] Filed: Jun. 19, 1985

[51] Int. Cl.[4] ..... G10D 3/08

[52] U.S. Cl. ..... 84/317

[58] Field of Search ..... 84/315–318

[56] References Cited

U.S. PATENT DOCUMENTS 1,735,145 11/1929 Taubert ..... 84/317

2,132,281 10/1938 Adamson ..... 84/317

3,837,255 9/1974 Starns et al. ..... 84/317

4,428,273 1/1984 Favron ..... 84/317

*Primary Examiner*—Benjamin R. Fuller

*Attorney, Agent, or Firm*—Richard C. Litman

[57] ABSTRACT

A device comprising mechanical means for fingering the fret board of a stringed instrument such as a guitar. The mechanical means includes a plurality of buttons, slide members, levers and string engaging members. By depressing an individual button, a plurality of the string engaging members will press a like number of strings against the frets, thus establishing a chord.

3 Claims, 5 Drawing Figures

CHORD SELECTOR FOR A STRINGED INSTRUMENT

The present invention relates to a device having mechanical means to perform the fingering on a stringed musical instrument.

Prior devices disclose an attachment for stringed instruments, such as a guitar, a banjo or the like, wherein the attachment has means to perform the fingering within a limited range. An example of such an attachment appears in U.S. Pat. No. 4,428,273 where it is required to be selectively positioned along the fret board in order to permit a full range of chords to be played.

The present device combines a fret board and a mechanical fingering means sufficient to establish any chord thereon into a single, integrated unit. Each chord is determined by merely selecting and depressing any one of a plurality of keys which will then be moved into engagement with a corresponding number of strings in order to depress each of these selected strings against a fret.

With this selector, it is possible to produce pure sounds because the strings are blocked in the exact position needed; pure sounds, not previously accomplished by the use of human fingers, can be achieved with this selector. For all stringed instruments, the pentagram method of writing and recording music is no longer necessary. The device utilizes the "uni-gram" (one-line) method, with numbers, which is ideally suited for any individual to perform pure musical sounds; timing is retained and it is no longer necessary to show or use sharps or flats.

For an individual to become a flawless soloist, only five lessons of basic instruction are required with the "uni-gram" system. For example, this selector can replace one guitar with 20 frets with a more perfect and correct sound capacity; with this selector, there are 200 full chords (80 major, 60 minor, and 60 7th). All of the musical tones (12 major, 12 minor) provide 24 scales (12 major, 12 minor). Each scale starts with the lowest sound and ends with the highest that can be found on an instrument. Any person can play the scales with one, two, three, four, or five notes, or in full chord.

Utilizing the selector, it is very easy to make any musical sound that is desired. In a guitar with 20 frets, with this device, the total musical capacity is 13,006 different melodic sounds. A guitar with 25 frets has 250 full chords; 100 major, 75 minor, and 75 7th. Total musical capacity is 16,256 different melodic sounds. Sounds are pure and melodic no matter what is played.

An object of the present invention is to enable one to finger a complete chord by merely pushing a single button. This can easily be expanded into a complete tune by sequentially depressing an appropriate series of buttons.

Another object is to permit a beginner to play a stringed instrument quickly. Eliminated is the need to learn and develop the necessary finger dexterity required to mainpulate a fret board properly. A further beneificial aspect of this device is for the handicapped. A person with only one finger on one of his hands can still enjoy and produce a stringed instrument sound since only one button needs to be depressed to establish a chord. Also, my instrument can easily be used by a left-handed guitar player without any difficulty.

An additional object is to establish a "pure" or "true" chord, wherein a miss, which can readily occur with manual fingering, is eliminated. Also, chords can be played on my instrument that are otherwise impossible for one to establish because of the size limitation of the human hand.

Other objects, advantages and novel features of the present invention will become apparent from the following detailed description of the invention when considered in conjunction with the accompanying drawing in which.

Figure 1:
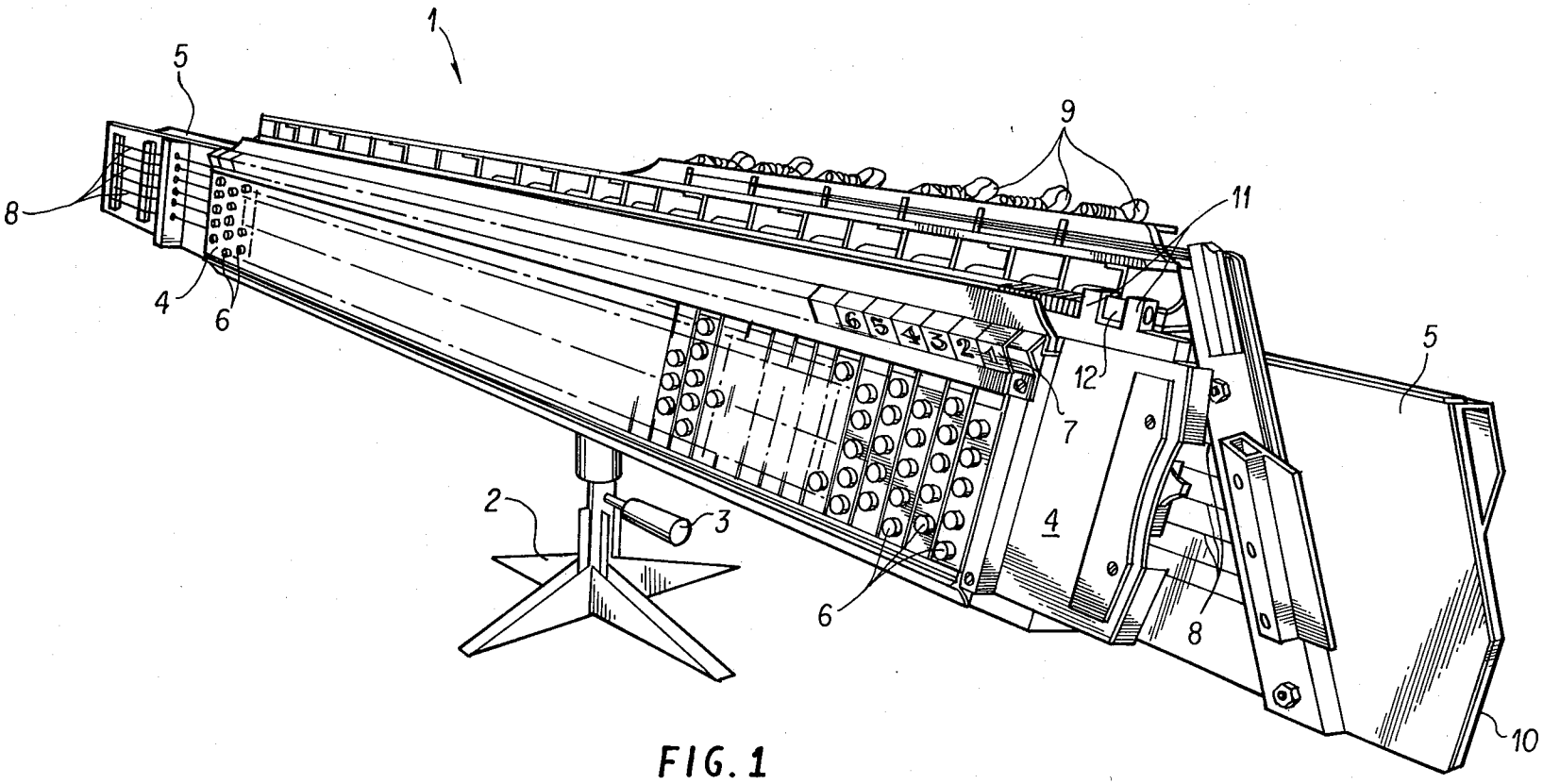
FIG. 1 is a front perspective view of this invention.

Referring to the drawing, FIG. 1 shows the selector 1 in its closed and operational position. The selector 1 is supported on a stand 2 which may be vertically adjusted by the pin means 3 and comprises an upper housing 4 and a lower housing 5. Located on the outer face of the upper housing 4 are a plurality of buttons 6. There are five buttons 6 in a single row and there are forty rows, thus providing a total of two hundred buttons. Each of these buttons, when actuated, will permit the operator to select a single chord. A plurality of numerals 7 are positioned above the buttons 6. Only numerals 1–6 are depicted in FIG. 1; however, this selector will have a total of forty numerals. These numerals will aid the operator in selecting the desired chord to be played. The selector of FIG. 1 carries a single set of six strings 8. They are shown at each end of the upper housing 4. These strings 8 are carried on the lower housing 5 and may be adjusted by turning the knobs 9. A sound box (not shown) will be attached to the end 10 of the lower housing 5. Complementary lugs 11 of the upper housing 4 and lug 12 of the lower housing 5 constitute a part of the connecting means between the two housings.

Figure 2:
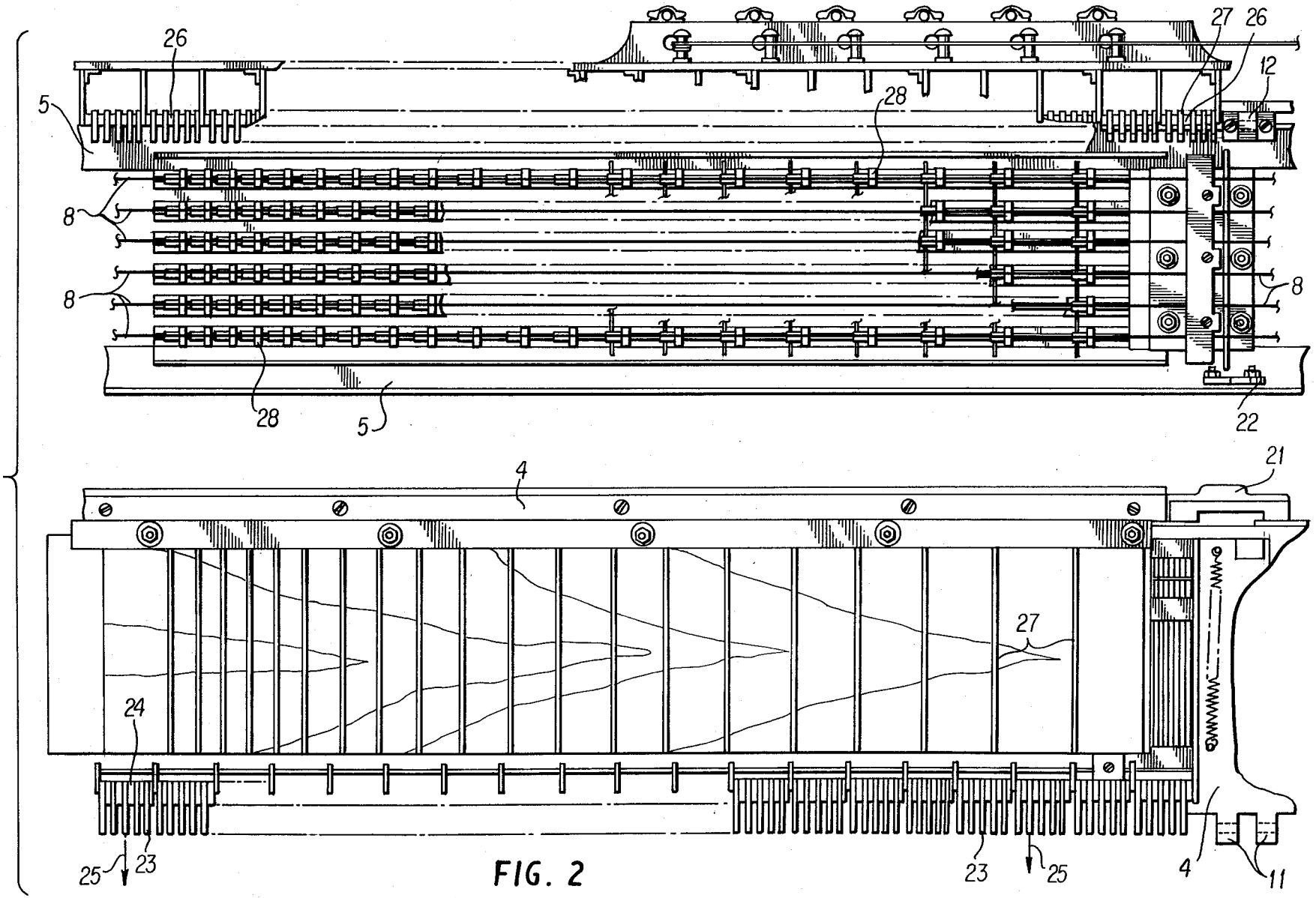
FIG. 2 is a partial plan view of the inner faces of the members in an opened position.

FIG. 2 shows the two housing members 4 and 5 in a disconnected position with their inner faces exposed. The two housing members are connected together along the upper edge of the upper edge of the selector 1 by the complementary lugs 11 and 12 and along the lower edge by the lug 21 and latch member 22. The connecting means at only one end of the selector 1 is shown. Most of the actuating means is positioned internally of the two housing members 4 and 5 and will be described in more detail with regard to the subsequent figures. However slide bars 23 are shown in FIG. 2 as depending from the lower edge of housing member 4 and are maintained in a spaced relationship with one another by the members 24. As will be described later in more detail, a slide bar 23 will move in the direction of the arrow 25 of FIG. 2 when a button 6 is depressed. In the closed position of the selector 1, an actuated slide bar 23 will engage and move a lever 26 about its hinge. The slide bars 23 are maintained in proper alignment with levers 26 by means of protruding, spacing members or frets 27 when the two housing members 4 and 5 are in the closed and latched position of FIG. 1. The frets are shown located on a neck. Each button 6 is connected to a single slide member 23 and each slide bar 23 actuates a single lever 26; thus there are two hundred slide bars 23 and two hundred levers 26 in the device of the disclosed embodiment. On the exposed surface of upper housing 4 of FIG. 2 are frets 27. Twenty frets are disclosed in the present embodiment. Since the number of frets may be increased or decreased, the number of chords that may be played will be correspondingly increased or decreased. Accordingly, the number of buttons 6, slide bars 23 and levers 26 will also be increased or decreased. Keys 28 are shows on the exposed surface of the lower housing 5 of FIG. 2. Each key 28 is capable of engaging one of the six strings 8, thus moving that portion of the string 8 against the fret 27 of the housing member 4 in order to complete a chord. Each string 8 has the same member of keys 28 as there are frets 27. The selector 1 of the present embodiment therefore has one hundred and twenty keys. The actuation of any one given lever 26 will produce movement of up to six keys 28; a maximum of one for each string 8. Since a chord requires that at least three strings be depressed, the minimum number of keys 28 that wil be moved by a lever 26 is therefore three.

Figure 3:
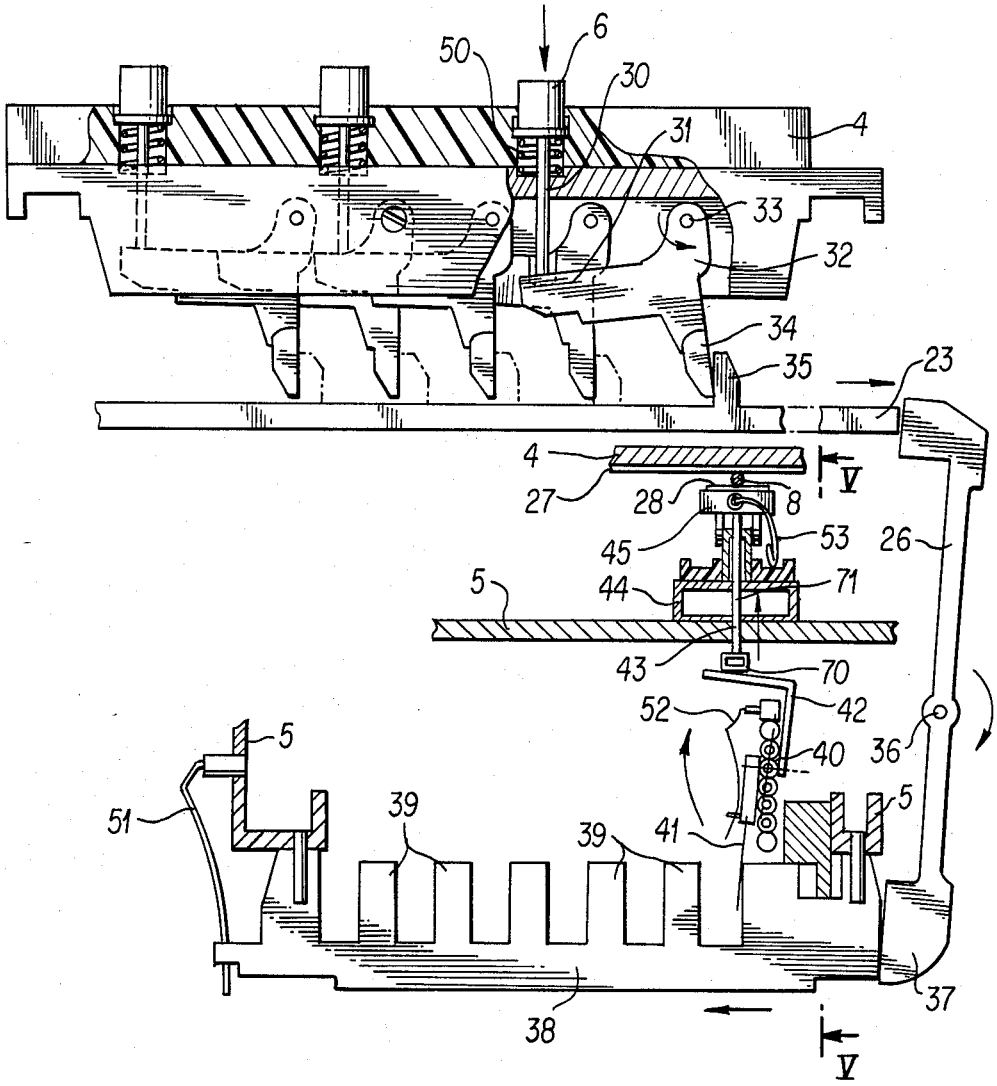
FIG. 3 is a partial cross-sectioned view of the instrument.

The entire mechanical movement of the selector 1 is shown in FIG. 3, wherein the initial movement of the button 6 can be followed throughout the several levers and slide bars to result in a string 8 being depressed against a fret 27. When a button 6 is depressed, a rod 30 depending therefrom engages one arm 31 of a second lever 32, causing the lever 32 to pivot about its hinge 33. The other arm 34 of lever 32 engages a protruding member 35 on the slide bar 23, whereby the slide bar is moved to the right as shown by FIG. 3. This movement causes lever 26 to pivot about its hinge 36, so that one arm 37 thereof engages and moves a slide bar 38 which is located within the lower housing 5. The slide bar 38 shown in FIG. 3 is provided with six teeth 39, wherein each tooth 39 will actuate a third lever 40 to move a key 28 against one of the six strings 8. It should be noted that, if in a certain chord only five strings are depressed, there will be only five teeth on that slide bar 38. A slide bar 38 having only three teeth 39 will produce a chord wherein only three strings 8 are depressed.

One arm of the third level 40 is in the form of depending finger 41 which engages a tooth 39 of slide bar 38. The other arm 42 of lever 40 engages an actuator 43 which is vertically journalled in member 44 of lower housing 5. The actuator 43 pivots a lever 45, thus forcing its key 28 into engagement with the string 8. This mechanical action will be better seen in FIG. 5, which is taken along the line V—V of FIG. 3.

Springs 50 act on button 6 to return the various members to their initial position. Spring 51 acts directly on second slide bar 38, which in turn moves lever 26, slide bar 23 and second lever 32 to their initial positions, while spring 52 acts on third lever 40. Spring 53 acts on lever 45, thereby causing the lever 45 and actuator 43 to return to their initial positions.

Figure 4:
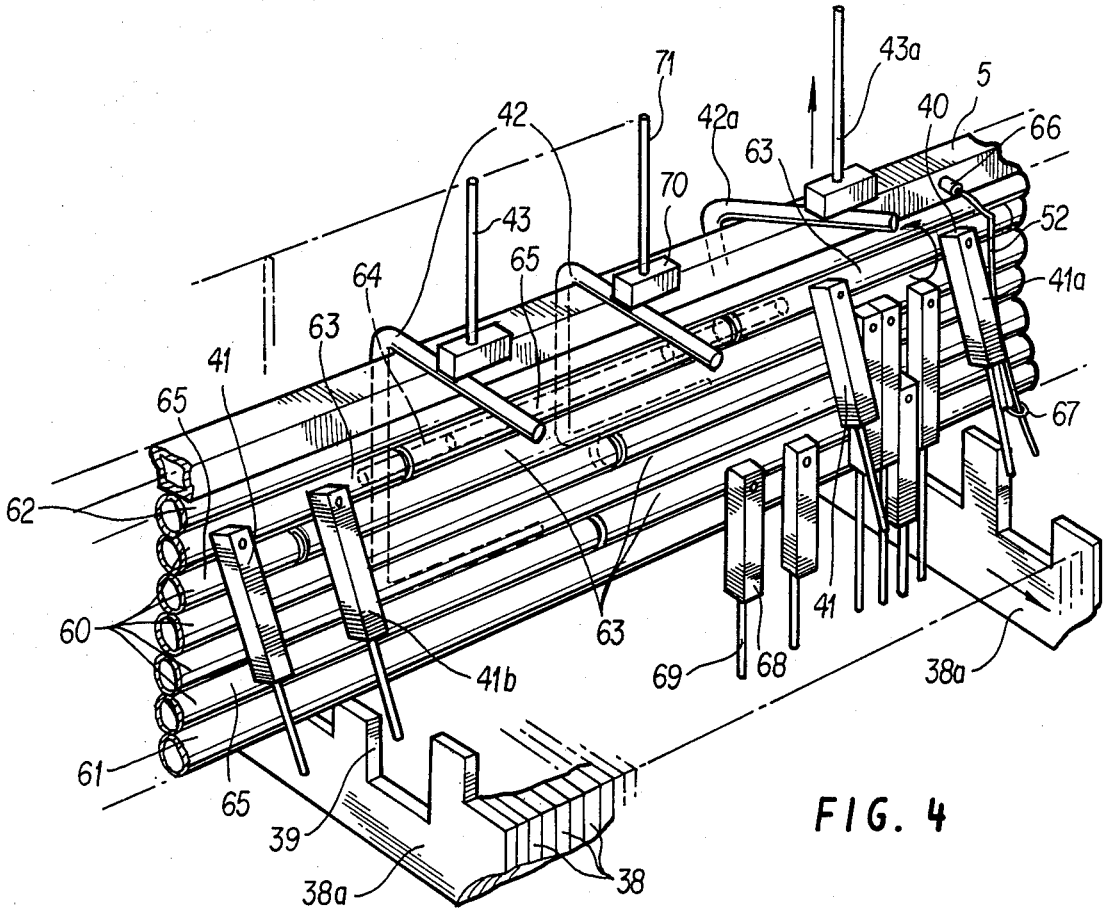
FIG. 4 is a partial perspective view showing a portion of the internal linkage.

FIG. 4 shows a detail of the mechanism of actuating the third lever 40. Five tubes 60 are stacked, one on top of the other. Tube 61 supports the bottom of the stack, while tube 62 is fixed at the top of the stack. Each tube 60 is divided into plurality of sections, wherein some of these tubular sections 63 are rotatably mounted on internal rods 64, while other sections 65 are fixed with respect to top and bottom tubes 61 and 62. Each tube 60 is also fixed at each end to the top and bottom tubes 61 and 62. Each third lever 40 comprises one or more rotatably mounted, tubular sections 63 and, along with the internal rod 64 thereof, constitutes the hinge of this third lever. The one or more rotatably mounted tubular sections 63 of each third lever 40 have a plurality of depending fingers 41 fixed thereto. Each of these depending fingers 41 constitutes one arm of said one third lever 40. There are, therefore, a plurality of depending arms for each third lever 40, but only one key actuating upper arm 42 for each third lever 40. Each third lever 40 has at least two depending fingers 41 and may have as many as ten depending fingers 41. While each different, depending finger 41 of a single third lever 40 is actuated by a different slide bar 38, only one upper arm 42 of that particular third lever 40 is actuated. Thus, a single key 28 may be actuated by any one of ten possible buttons 6. As shown in FIG. 4, the actuating slide bar at 38*a* engages and moves finger 41*a*, causing lever arm 42*a* to pivot upwardly, which in turn moves actuator 43*a* upwardly. Since depending finger 41*b* is also one of the lower lever arms for this particular third lever 40, upper lever arm 42*a* will also be actuated when the slide bar 38*b* is moved by the depression of the button 6 directly connected to slide bar 38*b*. As shown in FIG. 4, spring 52 is attached to the housing 5 at 66 and is slideably connected to the depending finger 41*a* by means of a ring 67. Also, each depending finger 41 comprises a thick, upper portion 68 which is fixed to a tubular section 63 and a thin rod 69 depending from the thick portion 68. The thin rod 69 is engaged by a tooth 39 on a slide bar 38 to pivot lever 40, about its hinge.

Figure 5:
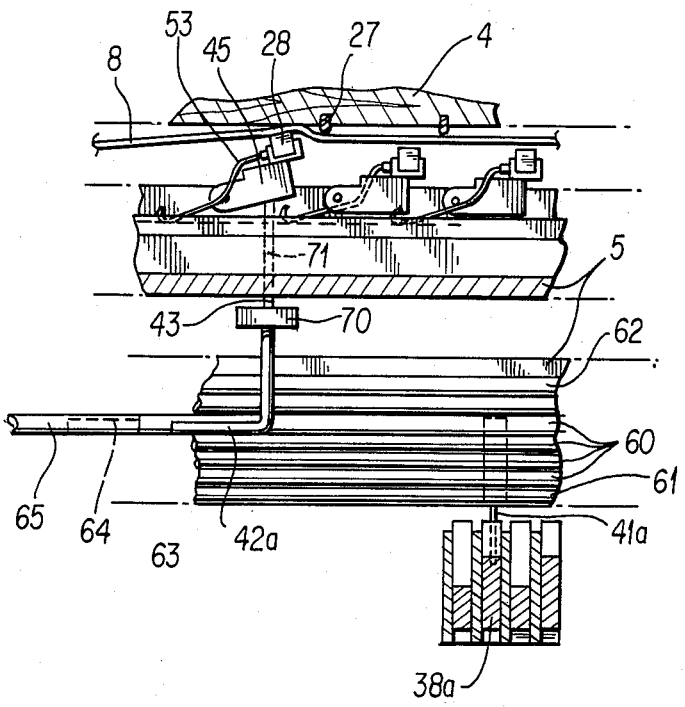
FIG. 5 is a partial cross-sectioned view taken along the line V—V of FIG. 3.

As shown in FIGS. 3, 4, and 5, the actuator 43 comprises a relatively large, lower portion 70 and a thin rod upper portion 71. Thus, the actuator 43 presents a relatively large surface for engagement with an arm 42.

FIG. 5 shows that portion of the mechanism wherein slide bar 38*a* pivots the depending finger 41*a* and the upper arm 42*a*, thereby vertically moving the actuator 43, which in turn pivots the lever 45 and thus moves the key 28 to depress the string 8 against a fret 27.

While not shown in the drawing, it should be noted that any of the mechanical movements may be electrically assisted and the device may be connected to a system that reproduces the sound electronically. It should also be considered apparent that the basic mechanical action may be useful in other and different combinations. The detailed embodiments are therefore intended to be only illustrative of the invention, without limiting the scope thereof.

I claim:

1. A stringed instrument comprising a neck having frets spaced longitudinally therealong and adjacent ones of the frets being positioned a same distance apart as corresponding frets on the neck, a plurality of strings spaced laterally thereacross, a plurality of buttons adapted to be actuated by a player's fingers, a lever having an arm, the lever being associated with each button and mounted to pivot in response to actuation of the button associated with the lever being actuated, a slide bar having a protruding member, the slide bar being associated with each of the levers and being moved laterally by the arm of the lever engaging the protruding member of the slide bar, a second lever having a first and second lever arm and pivotable about a pivot, the second lever being associated with each slide bar and pivots about its pivot in response to the slide bar contacting and moving the first lever arm of the second lever, a second slide bar having a plurality of teeth, the second slide bar engaged by and moved by the second lever arm of the second lever, a plurality of third levers in which each third lever has one or more first lever arms and one or more second lever arms, the one first lever arm of each of the third levers being in contact with a different tooth of the second slide bar and being rotationally moved by movement of the tooth with which it is in contact, a longitudinally extending, rotatably mounted tubular section attached to and providing an axis of rotation for each of the third levers and including the one or more second lever arms of each of the third levers, each second lever arm of the third lever being spaced on the tubular section the same distance apart as corresponding frets on the neck, and a key presser in contact with each second lever arm of the third lever in which the key presser moves against a string and holds a string in contact with a selected of the frets in response to rotational movement of a selected one of the third lever arms.

2. The apparatus of claim 1 wherein said neck together with the frets is supportably mounted on an upper housing.

3. The apparatus of claim 1 wherein the neck and a lower housing are mounted on a stand which is vertically adjustable by a pin means.

* * * * *